US009359867B2

(12) United States Patent
Pennewitz et al.

(10) Patent No.: US 9,359,867 B2
(45) Date of Patent: Jun. 7, 2016

(54) DESORPTION OF A DESICCANT BY RADIO WAVES OR MICROWAVES FOR A DOWNHOLE SORPTION COOLER

(75) Inventors: Erik Pennewitz, Niedersachsen (DE); Thomas Kruspe, Niedersachsen (DE); Sebastian Jung, Lower Saxony (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 750 days.

(21) Appl. No.: 13/105,604

(22) Filed: May 11, 2011

(65) Prior Publication Data

US 2012/0285178 A1 Nov. 15, 2012

(51) Int. Cl.
*F25B 27/00* (2006.01)
*E21B 36/00* (2006.01)

(52) U.S. Cl.
CPC ..... *E21B 36/001* (2013.01)

(58) Field of Classification Search
CPC ..... E21B 36/001
USPC ..... 62/238.3, 101, 109, 141, 476, 485, 3.1
See application file for complete search history.

(56) References Cited

U.S. PATENT DOCUMENTS 4,038,050 A 7/1977 Lowther
4,094,652 A 6/1978 Lowther
4,101,294 A 7/1978 Kimura
4,312,640 A 1/1982 Verrando
4,322,394 A 3/1982 Mezey et al.
4,407,136 A 10/1983 de Kanter
4,698,815 A * 10/1987 Bhowmik ..... H01S 3/0903 372/2
4,828,589 A * 5/1989 Bauer et al. ..... 96/109
4,930,294 A 6/1990 Meier
5,265,677 A 11/1993 Schultz
5,282,886 A 2/1994 Kobayashi et al.
5,429,665 A 7/1995 Botich
5,842,356 A 12/1998 Pfister et al.

(Continued)

FOREIGN PATENT DOCUMENTS

JP 10185347 7/1998
JP 2005299974 10/2005

OTHER PUBLICATIONS

International Search Report and Written Opinion dated Nov. 7, 2012 for International Application No. PCT/US2012/037453.

(Continued)

*Primary Examiner* — Marc Norman
*Assistant Examiner* — Ana Vazquez
(74) *Attorney, Agent, or Firm* — Cantor Colburn LLP

(57) ABSTRACT

A method, apparatus and system for cooling a component of a downhole tool is disclosed. The apparatus includes a first desiccant configured to adsorb a refrigerant gas. A transmitter is configured to transmit electromagnetic energy into the first desiccant to enable desorption of the refrigerant gas from the first desiccant. A condenser condenses the desorbed refrigerant gas into a liquid phase. The condensed refrigerant evaporates from a liquid phase to a gaseous phase to cool the component. A second desiccant can be used, wherein the processor is configured to operate the cooling system in a first mode of operation in which the first desiccant is in thermal communication with the component and the second desiccant is thermally isolated from the component and a second mode of operation in which the second desiccant is in thermal communication with the component and the first desiccant is thermally isolated from the component.

21 Claims, 4 Drawing Sheets

(56) References Cited

U.S. PATENT DOCUMENTS

| | | | | |
|---|---|---|---|---|
| 6,341,498 | B1 | 1/2002 | DiFoggio | |
| 6,672,093 | B2 | 1/2004 | DiFoggio | |
| 6,701,724 | B2 | 3/2004 | Smith et al. | |
| 6,877,332 | B2 | 4/2005 | DiFoggio | |
| 7,124,596 | B2 | 10/2006 | DiFoggio et al. | |
| 7,540,165 | B2 | 6/2009 | DiFoggio et al. | |
| 8,435,335 | B2 * | 5/2013 | Lam et al. | 96/126 |
| 2002/0104328 | A1 * | 8/2002 | DiFoggio | 62/259.2 |
| 2012/0006193 | A1 * | 1/2012 | Roychoudhury et al. | 95/11 |

OTHER PUBLICATIONS

Buchenhorst, D. "Anwendung von Radiowellen zur Erwarmung von Adsorbenzien und Katalysatoren," Universitat Halle-Witenberg, 2005, Abstract.

* cited by examiner

DESORPTION OF A DESICCANT BY RADIO WAVES OR MICROWAVES FOR A DOWNHOLE SORPTION COOLER

BACKGROUND OF THE DISCLOSURE

The present disclosure is related to sorption cooling of a component of a downhole tool. One way to cool a device downhole includes evaporating a refrigerant stored on the downhole tool from a liquid phase to a gaseous phase. Once the evaporated refrigerant has cooled the component, it is generally stored at a desiccant or other solid body which adsorbs the gas-phase refrigerant in the downhole tool until the tool is retrieved to the surface, at which time the refrigerant is removed and/or the refrigerant is desorbed from the desiccant by thermal heating. However, once the desiccant becomes saturated with refrigerant, the cooling operation ends. It is generally time-efficient and cost-efficient to regenerate the desiccant downhole by desorbing the evaporated refrigerant from the desiccant downhole rather than bringing the downhole tool to the surface. Known methods of desiccant regeneration include heating of the desiccant, reducing pressure within a volume of the desiccant, and purging the desiccant using a purge gas. However, due to temperatures and pressures experienced at downhole environments as well as operational considerations, the use of these methods is limited. The present disclosure provides a method and apparatus for desorbing refrigerant gas from a desiccant in a downhole cooling system.

SUMMARY OF THE DISCLOSURE

In one aspect, the present disclosure provides a method of cooling a component of a downhole tool, including transmitting electromagnetic energy into a desiccant having a refrigerant gas stored therein to enable desorption of the stored refrigerant gas from the desiccant; condensing the desorbed refrigerant gas into a liquid phase; and evaporating the refrigerant from the liquid phase to a gaseous phase to cool the component.

In another aspect, the present disclosure provides an apparatus for cooling a component of a downhole tool, including a desiccant configured to adsorb a refrigerant gas; a transmitter configured to transmit electromagnetic energy into the desiccant to enable desorption of the refrigerant gas from the desiccant; and a condenser configured to condense the desorbed refrigerant gas into a liquid phase, wherein the refrigerant evaporates from a liquid phase to a gaseous phase to cool the component.

In another aspect, the present disclosure provides a cooling system for a downhole tool, including: a first desiccant in controllable thermal communication with a component of the downhole tool; a second desiccant in controllable thermal communication with the component; and a processor configured to operate the cooling system in a first mode of operation in which the first desiccant is in thermal communication with the component and the second desiccant is thermally isolated from the component.

BRIEF DESCRIPTION OF THE DRAWINGS

For detailed understanding of the present disclosure, references should be made to the following detailed description, taken in conjunction with the accompanying drawings, in which like elements have been given like numerals and wherein.

DETAILED DESCRIPTION OF THE DISCLOSURE

Figure 1:
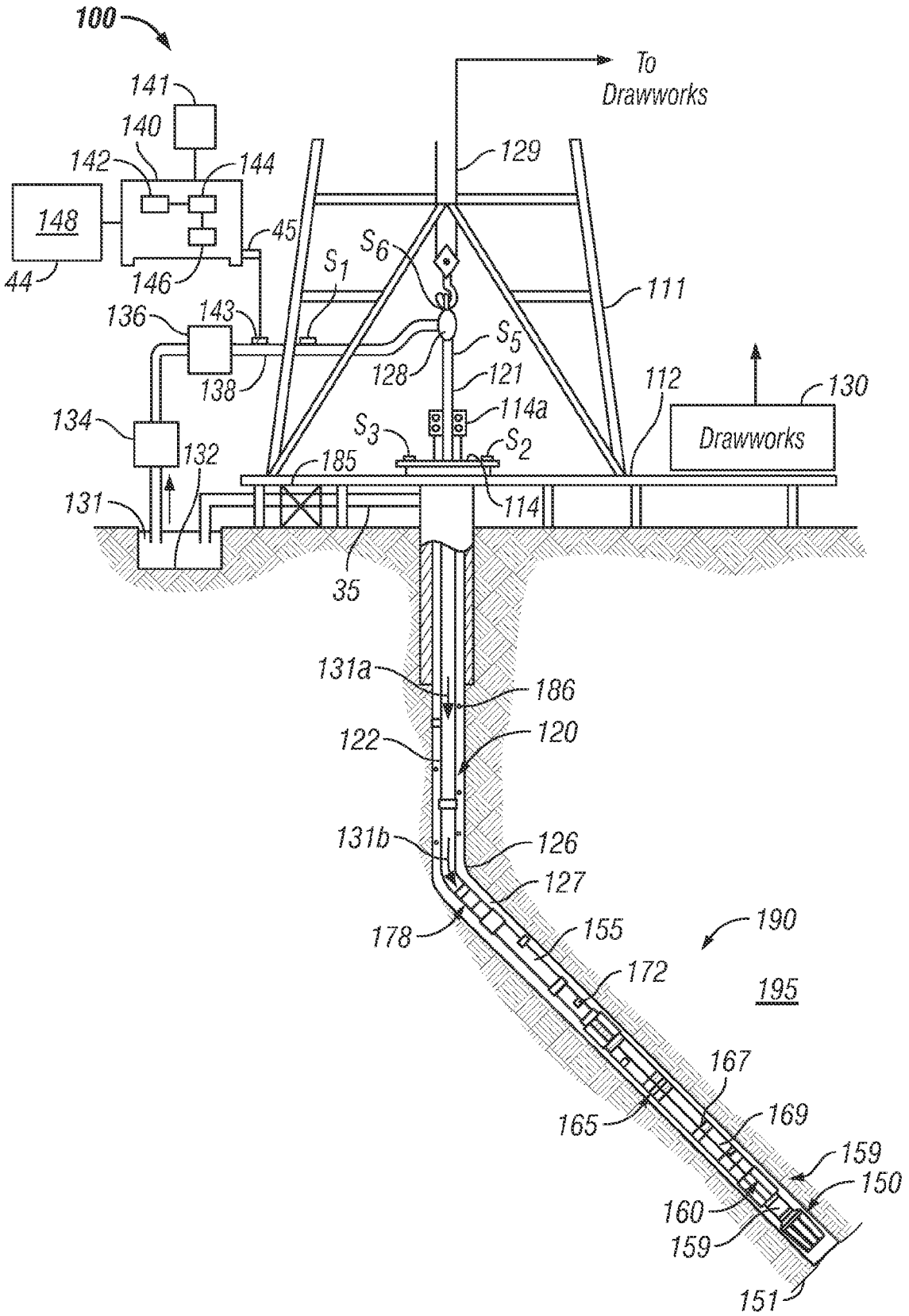
FIG. 1 is a schematic diagram of an exemplary drilling system for drilling a wellbore using an apparatus that can be operated according to the exemplary methods disclosed herein.

FIG. 1 is a schematic diagram of an exemplary drilling system 100 for drilling a wellbore using an apparatus that can be operated according to the exemplary methods disclosed herein. Exemplary drilling system 100 includes a drill string 120 that includes a drilling assembly or bottomhole assembly ("BHA") 190 conveyed in a wellbore 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe) 122 having the drilling assembly 190 attached at its bottom end extends from the surface to the bottom 151 of the wellbore 126. A drill bit 150, attached to drilling assembly 190, disintegrates the geological formations when it is rotated to drill the wellbore 126. The drill string 120 is coupled to a drawworks 130 via a Kelly joint 121, swivel 128 and line 129 through a pulley. Drawworks 130 is operated to control the weight on bit ("WOB"). The drill string 120 can be rotated by a top drive (not shown) instead of by the prime mover and the rotary table 114. The operation of the drawworks 130 is known in the art and is thus not described in detail herein.

In one aspect, a suitable drilling fluid 131 (also referred to as "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the drilling tubular discharges at the wellbore bottom 151 through openings in the drill bit 150. The returning drilling fluid 131*b* circulates uphole through the annular space 127 between the drill string 120 and the wellbore 126 and returns to the mud pit 132 via a return line 135 and drill cutting screen 185 that removes the drill cuttings 186 from the returning drilling fluid 131*b*. A sensor $S_1$ in line 138 provides information about the fluid flow rate. A surface torque sensor $S_2$ and a sensor $S_3$ associated with the drill string 120 provide information about the torque and the rotational speed of the drill string 120. Rate of penetration of the drill string 120 can be determined from the sensor $S_5$, while the sensor $S_6$ can provide the hook load of the drill string 120. Additionally, pressure sensor 182 in line 138 is configured to measure a mud pressure in the drill string.

In some applications, the drill bit 150 is rotated by rotating the drill pipe 122. However, in other applications, a downhole motor 155 (mud motor) disposed in the drilling assembly 190 also rotates the drill bit 150 via mud pumped through the mud motor. The rate of penetration ("ROP") for a given drill bit and BHA largely depends on the weight-on-bit (WOB) or the thrust force on the drill bit 150 and its rotational speed.

A surface control unit or controller 140 receives signals from downhole sensors and devices via a sensor 143 placed in the fluid line 138 and signals from sensors $S_1$-$S_6$ and pressure sensor 182 and other sensors used in the system 100 and processes such signals according to programmed instructions provided from a program to the surface control unit 140. The surface control unit 140 displays desired drilling parameters and other information on a display/monitor 141 that can be utilized by an operator to control the drilling operations. The surface control unit 140 can be a computer-based unit that can include a processor 142 (such as a microprocessor), a storage device 144, such as a solid-state memory, tape or hard disc, and one or more computer programs 146 in the storage device 144 that are accessible to the processor 142 for executing instructions contained in such programs to perform the methods disclosed herein. The surface control unit 140 can further communicate with a remote control unit 148. The surface control unit 140 can process data relating to the drilling operations, data from the sensors and devices on the surface, mud pressure measurements and data received from downhole and can control one or more operations of the downhole and surface devices such as methods of cooling operations for components of the drilling system 100. Alternately, the methods disclosed herein can be performed at a downhole processor 172.

The drilling assembly 190 can also contain formation evaluation sensors or devices (also referred to as measurement-while-drilling, "MWD," or logging-while-drilling, "LWD," sensors) determining resistivity, density, porosity, permeability, acoustic properties, nuclear-magnetic resonance properties, corrosive properties of the fluids or formation downhole, salt or saline content, and other selected properties of the formation 195 surrounding the drilling assembly 190. Such sensors are generally known in the art and for convenience are generally denoted herein by numeral 165. The drilling assembly 190 can further include a variety of other sensors and communication devices 159 for controlling and/or determining one or more functions and properties of the drilling assembly (such as velocity, vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc. A suitable telemetry sub 180 using, for example, two-way telemetry, is also provided as illustrated in the drilling assembly 190 and provides information from the various sensors and to the surface control unit 140.

Bottomhole assembly 190 can also include one or more cooling systems 169 configured to cool the various electronic components of the BHA 190. These various electronic components can include the formation evaluation sensors 165, accelerometers, magnetometers, photomultiplier tubes, strain gauges, and other components which incorporate transistors, integrated circuits, resistors, capacitors, and inductors, for example. In the present disclosure, the various electronic components are cooled by evaporation of a liquid as discussed in detail with respect to FIG. 2. Power to operate the exemplary cooling system of the present disclosure and/or the electronic components can be supplied by a battery, a wireline or any other typical power supply method such as the downhole motor 155 driven by drilling mud 131*a*. In other embodiments, power can be supplied by any power supply apparatus including an energy storage device located downhole, such as a battery.

Although the cooling system disclosed herein is discussed with respect to the exemplary drilling system 100 of FIG. 1, alternate embodiments wherein the cooling system is incorporated into a wireline tool is also considered within the scope of the present disclosure.

Figure 2:
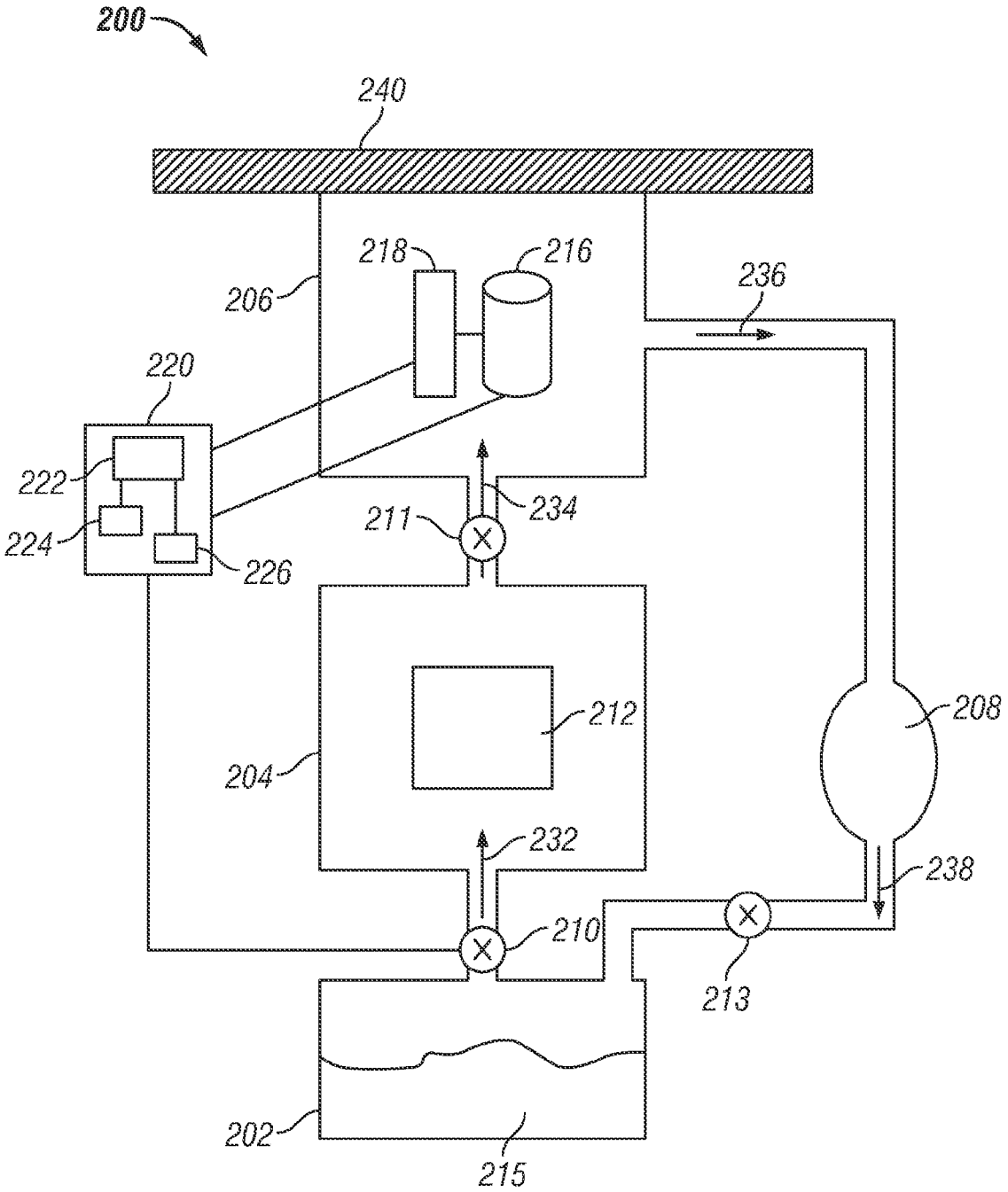
FIG. 2 shows an exemplary sorption cooling apparatus suitable for cooling a component of a downhole tool in one embodiment of the present disclosure.

FIG. 2 shows an exemplary sorption cooling apparatus 200 suitable for cooling a component of a downhole tool in one embodiment of the present disclosure. The sorption cooling apparatus 200 utilizes the potential energy of sorption as a source of energy to pump heat from a first region of the tool to a second region of the tool. The exemplary sorption cooling apparatus 200 includes a storage tank 202 for storing refrigerant 215, a chamber 204 housing an electronic component of the downhole tool for cooling, and a heat sink region 206 having a desiccant or other solid for gas adsorption. In one embodiment, the chamber 204 housing the electronic component can be inside a Dewars flask. In an alternate embodiment, the storage tank 202 and the cooling chamber 204 can be combined into one chamber with liquid refrigerant and cooling component stored therein. Storage tank 202 stores the refrigerant 215 for use in cooling the component of chamber 204, typically in a liquid phase. In an exemplary embodiment, the refrigerant is water. However, the refrigerant can be any fluid suitable for use as a refrigerant in a downhole environment. A portion of a refrigerant 215 evaporates to cool component 212, thereby keeping the component within a suitable operating temperature range. Valve 210 can be opened to enable evaporation of the refrigerant into a gaseous phase 232 to draw heat away from the component 212 in chamber 204. The spent refrigerant gas 234 (refrigerant gas carrying heat away from component 212) is routed to heat sink region 206. Valves 210 and 211 can be opened to allow routing of the refrigerant from storage tank 202 to heat sink region 206 via cooling chamber 204. At the same time, valve 213 is closed. The heat sink region 206 includes a desiccant 216 for adsorbing the spent refrigerant gas 234 and an electromagnetic transmitter 218 configured to transmit electromagnetic energy into the desiccant 216 for gas desorption. Desorption of the refrigerant gas is also referred to herein as desiccant regeneration. Upon arriving at the heat sink region 206, the spent refrigerant gas 234 is adsorbed by desiccant 216. The heat sink region 206 can be in thermal contact with the downhole tool housing 240 which is in thermal contact with the wellbore to dissipate heat to the wellbore.

Transmitter 218 can be activated to transmit electromagnetic energy into the desiccant and/or to the adsorbed refrigerant gas to thereby excite the refrigerant gas to desorb from the desiccant. In various embodiments, the electromagnetic energy is transmitted in a microwave energy range or a radio frequency range. A typical radio frequency range is from about 5 MHz to about 20 Mhz and a typical microwave frequency range is from about 3 GHz to about 20 GHz. In an exemplary embodiment, the transmitted energy heats the refrigerant to a temperature from about 250° C. to about 500° C. to desorb the refrigerant from the desiccant.

Desorbed refrigerant 236 is routed to exemplary condenser 208. Valve 211 can be closed during regeneration to prevent desorbed refrigerant from entering chamber 204 from heat sink 206. The exemplary condenser 208 condenses the desorbed refrigerant gas to a liquid phase 238 which is deposited to the refrigerant storage tank 202. Valve 213 can be opened and valve 210 can be closed to allow the liquid to flow from the condenser to the storage tank 202. Condensing the refrigerant back to the liquid phase completes a cooling cycle for the refrigerant. Once deposited in the storage tank 202, valve 213 can be closed and valves 210 and 211 can be opened so that the liquid refrigerant can be evaporated again to begin another cooling cycle.

The exemplary sorption cooling apparatus 200 further includes a control unit 220 configured to operate various components of the cooling system. The control unit 220 receives signals from various sensors and devices and processes such signals according to programmed instructions provided from a program to the control unit 220. The control unit 220 can in one embodiment be a computer-based unit that can include a processor 222 (such as a microprocessor), a storage device 224, such as a solid-state memory, tape or hard disc, and one or more computer programs 226 in the storage device 224 that are accessible to the processor 222 for executing instructions suitable for cooling component 212. In various embodiments, the control unit 220 and/or processor 222 are cooled or thermally insulated. In one embodiment, the processor 222 can include downhole processor 172 of FIG. 1.

In one aspect, control unit 220 controls the opening and closing of valves 210 and 211. In another aspect, the control unit controls operation of transmitter 218 to affect the timing and duration of the transmission of electromagnetic waves into the desiccant as well as to select the frequency of the transmitted waves. The control unit 220 also receives various signals indicative of a saturation level of the desiccant. The saturation level generally refers to a percentage of the desiccant unavailable for gas adsorption. The processor typically compares the saturation level signal to a selected saturation criterion. When the saturation level signal is at or above the selected saturation criterion, the processor activates the transmitter to transmit energy for desorbing the refrigerant gas from the desiccant. In an exemplary embodiment, the selected saturation criterion can be a 95% saturation level, although any suitable criterion can be used.

In various embodiments, transmitter 218 transmits radio waves and/or microwaves into the desiccant volume to heat up the adsorbed refrigerant at the desiccant and enable desorption of the refrigerant from the desiccant. Therefore, the refrigerant is recycled for use without bringing the desiccant or the downhole tool to a surface location. Some desiccants are transparent at radio and microwave frequencies. Therefore, radio waves and microwaves heats only the adsorbed refrigerant while the desiccant remains relatively unheated. If the desiccant is of a material that has high dielectric losses, then the radio waves and micro waves also heat up the desiccant along with the adsorbed refrigerant, leading to additional indirect heating of the refrigerant by the desiccant. In general, the dielectric loss of the desiccant, and therefore the efficiency of heating the adsorbent, increases with temperature and with the amount of refrigerant (generally water) stored at the desiccant. In general, desorption via radio or microwave radiation consumes less power than other heating methods and can be performed in a short amount of time. Thus, the desiccant can be quickly regenerated. The decreased regeneration time is suitable for a cyclic sorption cooler usable downhole.

Figure 3:
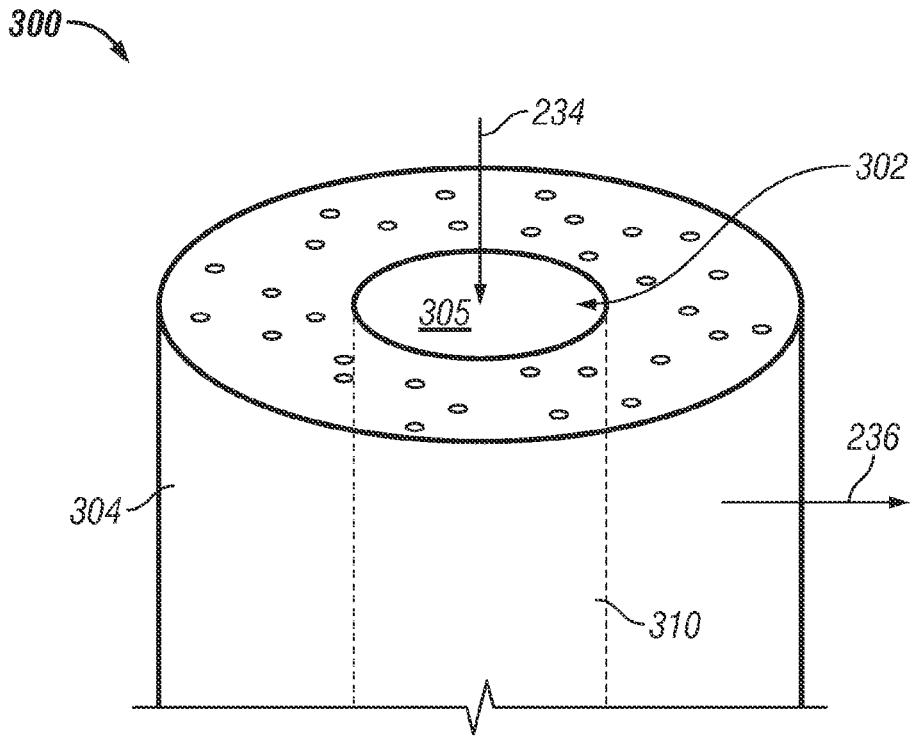
FIG. 3 shows a side view of an exemplary desiccant suitable for use in adsorbing refrigerant in the exemplary cooling apparatus of FIG. 2.

FIG. 3 shows a side view of an exemplary desiccant 300 suitable for use in adsorbing refrigerant in the exemplary cooling apparatus 200 of the present disclosure. The exemplary desiccant can be a molecular sieve like zeolite or charcoal or silica gel or other suitable desiccants for adsorbing spent refrigerant. In an exemplary embodiment, desiccant 300 is in the shape of an annular cylinder having an inner surface 302 and an outer surface 304. The spent refrigerant 234 is introduced from the cooling chamber into a central region 305 and is adsorbed onto the annular cylinder volume by a process of adhesion of the refrigerant molecules onto the desiccant. The inner surface 302 can include a porous inlet 310 for passage of the refrigerant gas from central region 305 into the desiccant. Desorbed gas 236 can exit the desiccant through inner surface 302 and/or the porous inlet 310. The inner surface 302 and outer surface 304 can further include various electrodes for measuring properties of the desiccant. Outer surface 304 can further include a housing of the desiccant. An exemplary placement of electrodes and their use with respect to the disclosed sorption cooling system are discussed with respect to FIG. 4.

Figure 4:
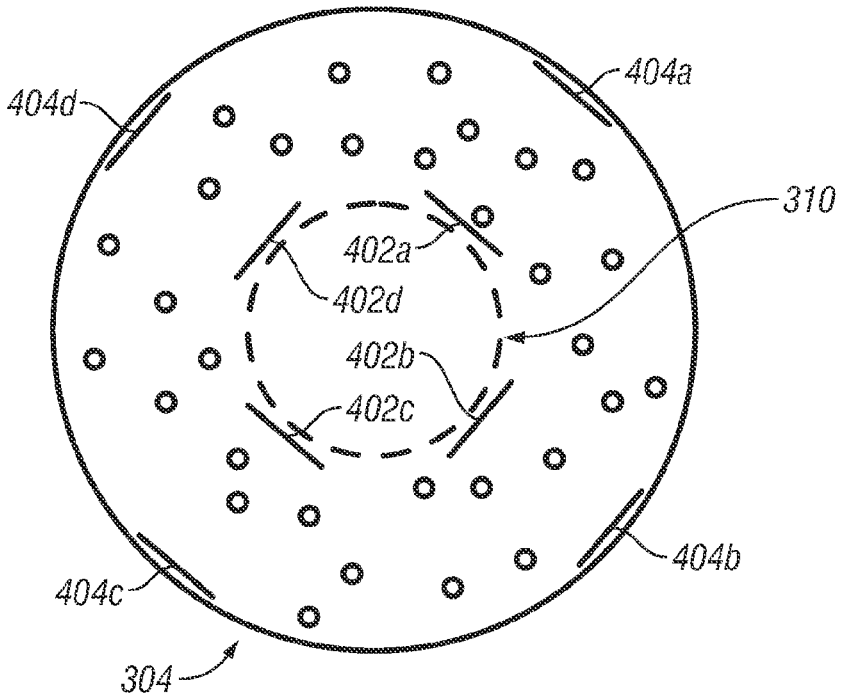
FIG. 4 shows a top view of the exemplary desiccant of FIG. 3.

FIG. 4 shows a top view of the exemplary desiccant of FIG. 3. Various exemplary electrodes 402*a*, 402*b*, 402*c*, 402*d* are shown at the inner surface 302 of the desiccant. Additionally, various exemplary electrodes 404*a*, 404*b*, 404*c*, 404*d* are shown at the outer surface 304. One or more of these electrodes can be mounted within the desiccant volume. Alternatively, the desiccant housing at the outer surface 304 and/or the porous inlet 310 at the inner surface 302 can be used as electrodes. Typically an electrode on the outer surface is operationally paired with a complementary electrode on the inner surface. Therefore, electrodes 402*a* and 404*a* form an operative pair, etc. Although four electrode pairs are shown in the exemplary desiccant volume, this is only for illustrative purposes. Any number of electrodes can be used with the present disclosure.

In various embodiments, the electrode pairs are used to determine a saturation level of the desiccant. One electrode pair (for example, electrodes 402*a* and 404*a*) can be used to induce a voltage across the desiccant volume between the inner surface 302 and outer surface 304. Another electrode pair (for example, electrodes 402*b* and 404*b*) can be used to measure a current in the desiccant volume in response to the induced voltage. Alternately, one electrode pair can be used to induce a current across the desiccant volume while another electrode pair measures a voltage in the desiccant volume in response to the induced current. Furthermore, one pair of electrodes can be used to induce a voltage or current and measure a current or voltage in the desiccant volume in response to the induced voltage or current. The measured voltage and current can be used to determine an impedance using $R=V/I$, where R is the determined impedance, V is the induced voltage, and I is the current. Due to the electrode configuration and operational capabilities, a measurement of two-point impedance is possible as well as a measurement of four-point impedance. In various embodiments, the determined impedance is related to an amount of refrigerant gas stored at the desiccant. Therefore, the determined impedance can be compared to a selected impedance criterion to determine if the desiccant is at or above a selected saturation level. The comparison can be performed at a processor, such as the exemplary processor 222 of the control unit 220 of FIG. 2. If the impedance is at or above the selected saturation criterion, the processor can activate one or more of the electrodes (for example, electrodes 402*c* and 404*c*) to transmit electromagnetic energy into the desiccant volume to enable the refrigerant gas to desorb from the desiccant. In another aspect of the disclosure, the measured impedance can be compared to a selected regeneration criterion indicating that the desiccant is substantially regenerated, or in other words, that the refrigerant has been substantially desorbed from the desiccant. An appropriate regeneration criterion can be less that 5% of the desiccant storing refrigerant, for example. By comparing the signals from the electrodes with the selected regeneration criterion, the processor can take an appropriate action to end the desorption process, such as deactivating the transmitter. In various aspects, a particular electrode pair can be used both to induce a voltage and to determine a current responsive to the induced voltage. In addition, any of the electrodes can be used to transmit electromagnetic energy into the desiccant volume.

Figure 5:
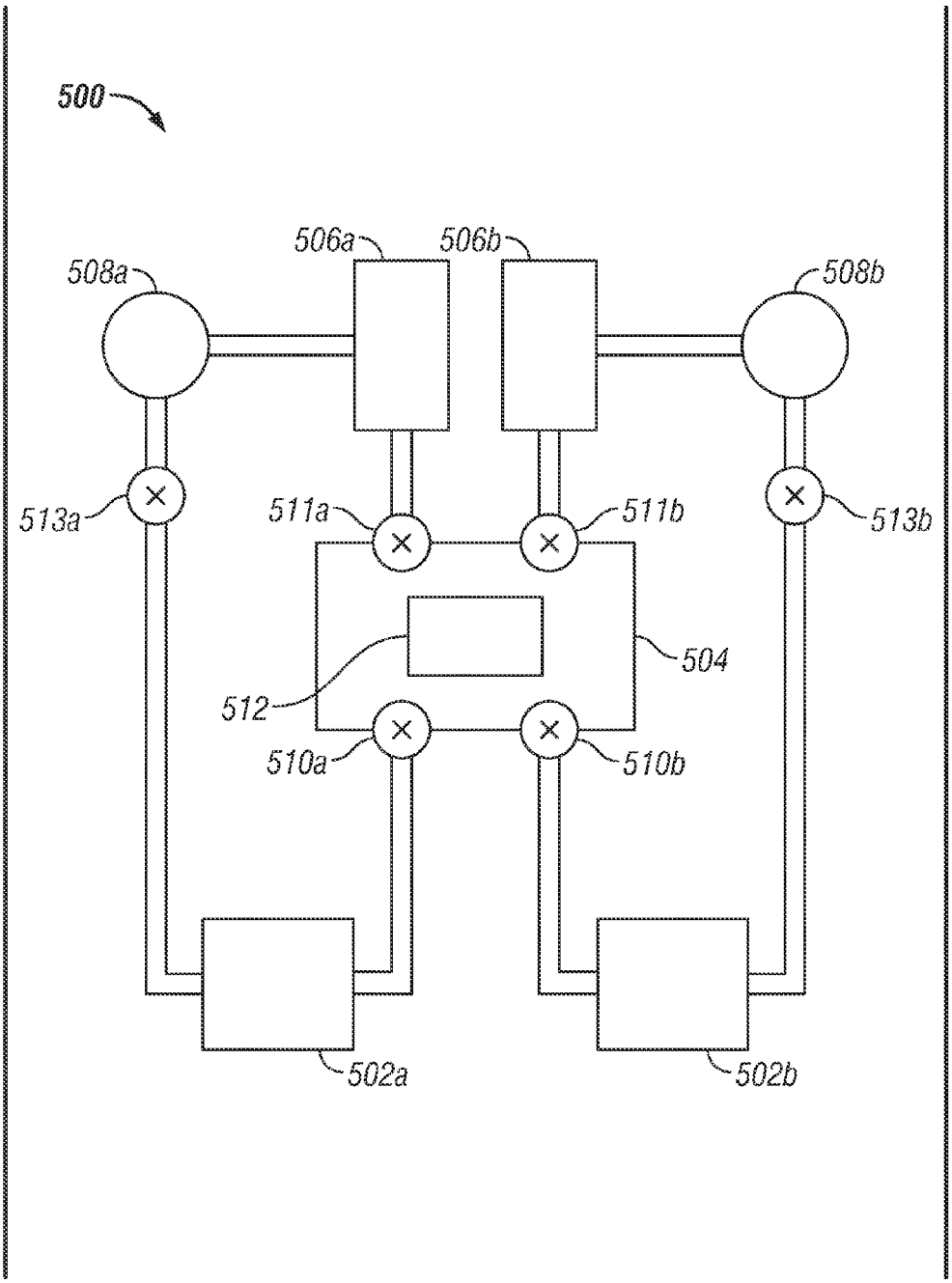
FIG. 5 shows an alternate embodiment of an exemplary cooling system of the present disclosure wherein multiple sorption cooling units are used to cool a downhole component.

FIG. 5 shows an alternate embodiment of an exemplary cooling system 500 of the present disclosure wherein multiple sorption cooling units are used to cool a downhole component. FIG. 5 shows a chamber 504 housing component 512 to be cooled. First and second storage tanks 502*a* and 502*b* store refrigerant to be evaporated to cool component 512. First and second heat sinks 506*a* and 506*b* store desiccants for gas adsorption and electromagnetic transmitters for regeneration of the desiccants through desorption of the gas, as discussed above with respect to FIG. 2. First and second condensers 508*a* and 508*b* condense the respective desorbed gases into a liquid form for return to respective storage tanks. Inlet valves 510*a* and 510*b* can be opened and closed to control gas transfer between the respective storage tanks 502*a* and 502*b* and the chamber 504. Outlet valves 511*a* and 511*b* can be opened and closed to control gas transfer between the chamber and the respective heat sinks 506*a* and 506*b*. Valve 513*a* can be opened and closed to control gas transfer and liquid transfer between condensers 508*a* and storage tank 502*a*. Similarly, valve 513*b* can be opened and closed to control gas transfer and liquid transfer between condensers 508*b* and storage tank 502*b*. A first cooling unit includes storage tank 502*a*, heat sink 506*a* and condenser 508*a*. A second cooling unit includes storage tank 502*b*, heat sink 506*b* and condenser 508*b*. In a first mode of operation, inlet valve 510*a* and outlet valve 511*a* are in an open position while inlet valve 510*b* and outlet valve 511*b* are closed. In a second mode, inlet valve 510*a* and outlet valve 511*a* are closed while inlet valve 510*b* and outlet valve 511*b* are open.

When in the first mode, second storage tank 502*b* and second heat sink 506*b* are isolated from chamber 504 while first storage tank 502*a* and first heat sink 506*a* are in thermal contact with chamber 504. Refrigerant from storage tank 502*a* is used to cool the component 512 and the desiccant in heat sink 506*a* is used to adsorb refrigerant. At the same time, the desiccant in heat sink 506*b* is isolated from chamber 504 and the desiccant within heat sink 506*b* can be regenerated. After a selected amount of time or when a selected condition occurs, a control unit (not shown) such as control unit 220 switches the cooling system 500 to the second mode of operation. One selected condition can include substantial saturation of the desiccant of heat sink 506*a*. A second selected condition can include substantial regeneration of the desiccant of heat sink 506*b*. In the second mode of operation, the first storage tank 502*a* and first heat sink 506*a* is isolated from chamber 504 and the second storage tank 502*b* and second heat sink 506*b* is in thermal contact with chamber 504. Therefore, in the second mode, the desiccant of heat sink 506*b* adsorbs refrigerant originating from second storage tank 502*b* while the desiccant of heat sink 506*a* can be regenerated. The control unit switches the cooling system 500 back to the first mode of operation after a selected amount of time or when a selected condition occurs, such as substantial saturation of the desiccant of the second heat sink 506*b* or substantial regeneration of the desiccant of the first heat sink 506*a*. Although two sorption cooling units are shown in FIG. 5, an embodiment using more than two cooling units is considered within the scope of the present disclosure. In such embodiments, multiple desiccants can be regenerated while a particular desiccant adsorbs refrigerant gas.

Therefore, in one aspect, the present disclosure provides a method of cooling a component of a downhole tool, including transmitting electromagnetic energy into a desiccant having a refrigerant gas stored therein to enable desorption of the stored refrigerant gas from the desiccant; condensing the desorbed refrigerant gas into a liquid phase; and evaporating the condensed refrigerant from the liquid phase to a gaseous phase to cool the component. The evaporated refrigerant is adsorbed in the gaseous phase at the desiccant after it has cooled the component. A parameter indicative of a refrigerant saturation level at the desiccant can be measured and electromagnetic energy can be transmitted into the desiccant when the measured parameter meets a selected saturation criterion. Additionally, the transmission of the electromagnetic energy into the desiccant can be ended when the measured parameter meets a selected regeneration criterion or after a selected amount of time. In various embodiments, the measured parameter is an electrical impedance of the desiccant. A frequency of the electromagnetic energy can be in a microwave range from about 3 GigaHertz (GHz) to about 20 GHz and/or in a radio frequency range from about 5 Megahertz (MHz) to about 20 MHz. Typically, the electromagnetic energy heats at least one or the desiccant and the refrigerant at the desiccant to a temperature in a range from about 250° C. to about 500° C. to desorb the stored refrigerant gas. In various embodiments, the component is conveyed downhole using a wireline device or a measurement-while-drilling device.

In another aspect, the present disclosure provides an apparatus for cooling a component of a downhole tool, including a desiccant configured to adsorb a refrigerant gas; a transmitter configured to transmit electromagnetic energy into the desiccant to enable desorption of the refrigerant gas from the desiccant; and a condenser configured to condense the desorbed refrigerant gas into a liquid phase, wherein the condensed refrigerant evaporates from a liquid phase to a gaseous phase to cool the component. Typically the desiccant adsorbs the evaporated refrigerant gas in the gaseous phase once the refrigerant gas has cooled the component. The apparatus also includes a processor configured to measure a parameter related to a refrigerant saturation level at the desiccant, and activate the transmitter when the parameter meets a selected saturation criterion. The process can also deactivate the transmitter when the measured parameter meets a selected regeneration criterion or after a selected amount of time from the beginning of the transmission of the electromagnetic energy into the desiccant. In one embodiment, the processor measures an electrical impedance of the desiccant to determine the refrigerant saturation level at the desiccant. A frequency of the electromagnetic energy can be in a microwave range from about 3 GHz to about 20 GHz and/or in a radio frequency range from about 5 MHz to about 20 MHz. Typically, the transmitter heats at least one of the desiccant and the refrigerant gas at the desiccant to a temperature in a range from about 250° C. to about 500° C. to desorb the refrigerant gas. In various embodiments, the component can be conveyed downhole using a wireline device or a measurement-while-drilling device.

In another aspect, the present disclosure provides a cooling system for a downhole tool, including: a first desiccant in controllable thermal communication with a component of the downhole tool; a second desiccant in controllable thermal communication with the component; and a processor configured to operate the cooling system in a first mode of operation in which the first desiccant is in thermal communication with the component and the second desiccant is thermally isolated from the component. The processor is further configured to activate desorption of a refrigerant gas from the second desiccant during the first mode of operation. Also, the first desiccant adsorbs refrigerant used to cool the component during the first mode of operation. The processor is further configured to switch the cooling system to a second mode of operation in which the first cooling unit is thermally isolated from the component and the second cooling unit is in thermal communication with the component based on one of (i) a saturation level of the first desiccant, (ii) a saturation level of the second desiccant, and (iii) a passage of a selected amount of time.

While the foregoing disclosure is directed to the exemplary embodiments of the disclosure, various modifications will be apparent to those skilled in the art. It is intended that all variations within the scope and spirit of the appended claims be embraced by the foregoing disclosure.

What is claimed is:

1. A method of cooling a component of a downhole tool, comprising:

disposing a desiccant directly on the downhole tool, the desiccant being in a shape of an annular cylinder having an inner surface and an outer surface, wherein the inner surface includes a porous inlet;

adsorbing a refrigerant gas through the porous inlet at the inner surface of the desiccant, the refrigerant gas carrying heat from the component of the downhole tool;

measuring an impedance of the desiccant using at least one electrode pair embedded in the desiccant to determine a saturation level of the desiccant, wherein the at least one electrode pair includes an electrode at the inner surface and an electrode at the outer surface;

activating the at least one electrode pair to transmit electromagnetic energy into the desiccant to enable desorption of the refrigerant gas from the desiccant while downhole when the saturation level is at or above a selected saturation criterion;

condensing the desorbed refrigerant gas into a liquid phase; and storing the condensed refrigerant gas at a storage tank of the downhole tool.

2. The method of claim 1, further comprising adsorbing the evaporated refrigerant in the gaseous phase at the desiccant upon cooling the component.

3. The method of claim 1, further comprising measuring a parameter indicative of a refrigerant saturation level at the desiccant using the at least one electrode pair and transmitting the electromagnetic energy into the desiccant when the measured parameter meets the selected saturation criterion.

4. The method of claim 3 further comprising ending transmission of the electromagnetic energy into the desiccant when a condition is met, wherein the condition is one of: (i) the measured parameter meets a selected regeneration criterion; and (ii) a selected amount of time.

5. The method of claim 3, wherein the measured parameter is an electrical impedance of the desiccant.

6. The method of claim 1, wherein a frequency of the electromagnetic energy is at least one of: (a) in a microwave range from about 3 GigaHertz (GHz) to about 20 GHz; and (b) in a radio frequency range from about 5 Megahertz (MHz) to about 20 MHz.

7. The method of claim 1 wherein the electromagnetic energy heats at least one of the desiccant and the refrigerant at the desiccant to a temperature in a range from about 250° C. to about 500° C. to desorb the stored refrigerant gas.

8. The method of claim 1, wherein the component is conveyed downhole using one of: (i) a wireline and (ii) a measurement-while-drilling device.

9. The method of claim 1, wherein measuring the impedance using the at least one electrode pair further includes one of: (i) inducing a voltage into the desiccant using a first electrode pair and measuring a current in the desiccant in response to the induced voltage using a second electrode pair; (ii) inducing a current in the desiccant using a first electrode pair and measuring a voltage in the desiccant in response to the induced current using a second electrode pair; (iii) using an electrode pair to induce a voltage in the desiccant and measure a current in the desiccant in response to the induced voltage; and (iv) using an electrode pair to induce a current in the desiccant and measure a voltage in the desiccant in response to the induced current.

10. An apparatus for cooling a component of a downhole tool, comprising:

a desiccant disposed directly on the downhole tool, the desiccant being in a shape of an annular cylinder having an inner surface and an outer surface and having a porous inlet at the inner surface, wherein the desiccant is configured to adsorb a refrigerant gas carrying heat from the component through the porous inlet at the inner surface of the desiccant;

a transmitter including at least one electrode pair embedded in the desiccant configured to determine a saturation level of the desiccant and to transmit electromagnetic energy into the desiccant to enable desorption of the refrigerant gas from the desiccant while downhole, wherein the at least one electrode pair includes an electrode at the inner surface and an electrode at the outer surface;

a condenser configured to condense the desorbed refrigerant gas into a liquid phase; and a storage tank of the downhole tool configured to receive the condensed refrigerant gas from the condenser, wherein the condensed refrigerant evaporates from the storage tank to cool the component; and a processor configured to measure an impedance of the desiccant to determine the saturation level of the desiccant using the at least one electrode pair and to activate the at least one electrode pair to transmit the electromagnetic energy into the desiccant when the saturation level is at or above a selected saturation criterion.

11. The apparatus of claim 10, wherein the desiccant adsorbs the evaporated refrigerant in the gaseous phase upon cooling the component.

12. The apparatus of claim 10, further comprising a processor configured to:

(i) measure a parameter related to a refrigerant saturation level at the desiccant, and (ii) activate the transmitter when the parameter meets the selected saturation criterion.

13. The apparatus of claim 12, wherein the processor further deactivates the transmitter when a selected condition is met, wherein the condition is one of: (i) the measured parameter meets a selected regeneration criterion; and (ii) a selected amount of time.

14. The apparatus of claim 12, wherein the parameter is an electrical impedance of the desiccant.

15. The apparatus of claim 10, wherein a frequency of the electromagnetic energy is at least one of: (a) in a microwave range from about 5 GHz to about 20 GHz; and (b) in a radio frequency range from about 5 MHz to about 20 MHz.

16. The apparatus of claim 10 wherein the transmitter heats at least one of the desiccant and the refrigerant gas at the desiccant to a temperature in a range from about 250° C. to about 500° C. to desorb the refrigerant gas.

17. The apparatus of claim 10, wherein the component is conveyed downhole using one of: (i) a wireline and (ii) a measurement-while-drilling device.

18. A cooling system for a downhole tool, comprising:

a first desiccant disposed directly on the downhole tool in controllable thermal communication with a component of the downhole tool, wherein the first desiccant is in a shape of an annular cylinder having an inner surface and an outer surface and a porous inlet at the inner surface;

at least one electrode pair embedded in the first desiccant, the at least one electrode pair including an electrode at the inner surface and an electrode at the outer surface;

a second desiccant disposed directly on the downhole tool in controllable thermal communication with the component; and a processor configured to operate the cooling system in a first mode of operation which includes:

placing the first desiccant having a refrigerant gas stored therein in thermal communication with the component and the second desiccant thermally isolated from the component;

adsorbing the refrigerant gas carrying heat from the component through the porous inlet at the inner surface of the first desiccant;

measuring an impedance of the first desiccant using the at least one electrode pair to determine a saturation level of the first desiccant;

activating the at least one electrode pair to transmit electromagnetic energy into the first desiccant to enable desorption of the stored refrigerant gas from the first desiccant while downhole when the saturation level is at or above a selected saturation criterion;

condensing the desorbed refrigerant gas into a liquid phase;

storing the condensed refrigerant gas at a downhole storage tank of the downhole tool; and evaporating the condensed refrigerant from the storage tank to cool the component.

19. The cooling system of claim 18, wherein the processor is configured to activate desorption of the refrigerant gas from the second desiccant during the first mode of operation.

20. The cooling system of claim 18, wherein the first desiccant adsorbs refrigerant used to cool the component during the first mode of operation.

21. The cooling system of claim 18, wherein the processor is further configured to switch the cooling system to a second mode of operation in which the first desiccant is thermally isolated from the component and the second desiccant is in thermal communication with the component based on one of: (i) a saturation level of the first desiccant, (ii) a saturation level of the second desiccant, (iii) a selected amount of time.

* * * * *